US009359919B1

(12) United States Patent
Berry

(10) Patent No.: US 9,359,919 B1
(45) Date of Patent: Jun. 7, 2016

(54) RECUPERATED RANKINE BOOST CYCLE

(71) Applicant: James E. Berry, Cherry Hill, NJ (US)

(72) Inventor: James E. Berry, Cherry Hill, NJ (US)

( * ) Notice: Subject to any disclaimer, the term of this patent is extended or adjusted under 35 U.S.C. 154(b) by 0 days.

(21) Appl. No.: 14/665,534

(22) Filed: Mar. 23, 2015

(51) Int. Cl.
*F01K 25/08* (2006.01)
*F01K 25/10* (2006.01)
*F01K 9/00* (2006.01)

(52) U.S. Cl.
CPC ..... *F01K 25/106* (2013.01); *F01K 9/00* (2013.01); *F01K 25/103* (2013.01)

(58) Field of Classification Search
CPC ..... F03G 7/00; F03G 6/00; F01K 25/08; F01K 25/06
See application file for complete search history.

(56) References Cited

U.S. PATENT DOCUMENTS 3,797,516 A * 3/1974 Forster ..... F02C 9/24 137/340
4,489,563 A * 12/1984 Kalina ..... F01K 25/065 60/673
5,029,444 A * 7/1991 Kalina ..... F01K 25/065 60/649
6,857,268 B2 * 2/2005 Stinger ..... F01K 25/08 60/651
7,287,381 B1 * 10/2007 Pierson ..... F01K 25/08 60/651
7,469,542 B2 * 12/2008 Kalina ..... F01K 25/065 60/649
7,516,619 B2 * 4/2009 Pelletier ..... F01K 25/065 60/649
8,474,262 B2 * 7/2013 Regelman ..... F01K 25/10 60/651
8,794,002 B2 * 8/2014 Held ..... F01K 3/185 60/651
8,869,531 B2 * 10/2014 Held ..... F01K 3/185 60/651
2004/0050048 A1 * 3/2004 Kalina ..... F03G 7/04 60/641.2
2006/0225423 A1 * 10/2006 Brostow ..... F01K 21/005 60/650
2006/0283206 A1 * 12/2006 Rasmussen ..... F01D 15/005 62/619
2007/0234722 A1 * 10/2007 Kalina ..... F01K 7/32 60/645
2010/0101227 A1 * 4/2010 Kalina ..... F01D 15/10 60/653
2010/0146973 A1 * 6/2010 Kalina ..... F01K 7/22 60/653
2010/0205962 A1 * 8/2010 Kalina ..... F01D 15/10 60/641.8
2011/0072818 A1 * 3/2011 Cook ..... F01K 13/02 60/645
2011/0278846 A1 * 11/2011 Landi ..... F01D 25/10 290/52

* cited by examiner

*Primary Examiner* — Thomas Denion
*Assistant Examiner* — Shafiq Mian
(74) *Attorney, Agent, or Firm* — Mendelsohn Dunleavy, P.C.; Steve Mendelsohn; Kevin J. Dunleavy

(57) ABSTRACT

An improvement to Rankine type heat recovery power cycles by adding heat source heat exchanger(s) in parallel with the existing recuperator(s) and in series with the existing heat source exchangers.

12 Claims, 5 Drawing Sheets

RECUPERATED RANKINE BOOST CYCLE

BACKGROUND OF THE INVENTION

1. Field of the Invention

The present invention is directed to heat recovery power cycles. In particular, to recuperated Rankine type heat recovery power cycles and/or recuperated closed Rankine/Brayton cycles.

2. Description of the Related Technology

A recuperated Rankine Cycle, as shown in FIG. 1, is a major improvement over a non-recuperated cycle for heat source temperatures above about 250° F.-350° F. (depending on the working fluid and operating conditions). Recovering heat in the recuperator from the expander exhaust, heat that would otherwise be wasted in the condenser, and using this heat to pre-heat the working fluid entering the heat source to working fluid heat exchanger, increases the power output of the cycle and reduces the heat load on the condenser, as compared to a non-recuperated cycle. However, there is a problem with this cycle. Increasing the temperature of the working fluid entering the heat source exchanger raises the final heat source fluid exit temperature, thus reducing the amount of heat that can be transferred to the cycle.

In the last 30 years or so there have been a number of improvements to Rankine type cycles, all of these ideas aiming to extract more energy from the waste heat stream and/or to limit the amount of heat rejected in the condenser compared to the FIG. 1 cycle. Following are some examples of these improvements.

In U.S. Pat. No. 7,287,381 B1 the cold working fluid flow from the pump is split with a first part directed to the recuperator with the second part directed to a lower temperature heat source fluid heat to a working fluid heat exchanger with the flows recombining at an intermediate point between the lower temperature heat source to the working fluid exchanger and a higher temperature heat source to the working fluid exchanger. The decreased cold side flow to the recuperator caused by the flow split, allows a greater temperature rise in the working fluid. The part of the working fluid flow that goes directly from the pump to the lower temperature heat source fluid to the working fluid exchanger without recuperation results in a lower final heat source fluid exhaust temperature and the transferring of additional heat to the working fluid. The total working fluid mass flow is increased, when compared to the typical FIG. 1 cycle, thus increasing power. However, the method described is limited to cycle conditions in which there is no phase change of the working fluid in either the recuperator or the low temperature section of the waste heat fluid to working fluid heat exchanger.

U.S. Pat. No. 4,489,563 describes a Kalina cycle. This dual fluid (ammonia and water) cycle improves performance in a number of ways including capturing some of the condensing heat, reducing the approach temperature throughout the heat transfer process, and by lowering the condensing pressure. This cycle is especially efficient in the waste heat temperature ranges of 100° C. to approximately 200° C. This cycle also uses the concept of splitting the pump flow between a recuperator heated working fluid stream and a heat source heated working fluid stream but the concept is limited to a multi-component fluid working fluid with evaporation of a portion of one of the fluid components taking place in at least one heat source heat exchanger and condensation of a portion of one of the components of the working fluid talking place in at least one of the recuperators. A disadvantage of this cycle is its complexity, the somewhat corrosive nature of ammonia/water working fluid and the toxicity of ammonia.

U.S. Pat. No. 6,857,268B discloses a cascading closed loop cycle that uses the recuperated heat from a first expander to heat the working fluid to a second expander, with a portion of the remaining first expander heat combining with recuperated heat from the second expander to provide preheat for the second expander's working fluid. This is a super critical cycle with propane as the suggested preferred working fluid. The cycle is significantly more efficient than the single recuperated cycle that is shown in FIG. 1 for waste heat temperatures above about 650° F. A disadvantage of this cycle is the need for two expanders.

U.S. Pat. No. 8,474,262 discloses an advanced tandem organic Rankine cycle that combines two of the FIG. 1 cycles with the exiting heat source fluid heat from the high temperature cycle used as the incoming heat source heat to the second cycle with the intermediate heat source fluid temperature selected to optimize the performance. This is also a super critical cycle with propane as the preferred working fluid. This cycle performs best above a waste heat temperature of about 600° F. This cycle also uses two expanders which add to its complexity. The performance is a few percentage points better than the above cascading closed loop cycle for most applications.

Various binary cycles have also been proposed with many operating in geothermal applications. These cycles use the condensing heat from a higher temperature Rankine cycle as the input heat to a lower temperature cycle. While complex, these cycles are well suited for low temperature heat source applications.

Considerable work has also been done optimizing working fluid selection to best fit the particular operating conditions of waste heat and condensing temperature for the FIG. 1 cycle. An example is GE's ORegen™ Cycle which uses cyclopentane as a working fluid. This fluid extracts more power directly in the expansion compared to most other fluids and has a relatively high thermal stability limit making it well suited for recovering power from gas turbine and piston engine exhaust streams. By extracting more power directly from the expansion means a lower expander exit temperature and therefore less heat to be recycled through the recuperator thus decreasing the size and cost of this exchanger. A disadvantage of cyclopentane is that the condensing pressure is sub-atmospheric at condenser coolant temperatures under about 40° C. Thus the full thermodynamic benefits of the fluid can not be utilized at normal and low ambient temperatures without resulting in the danger of air leaking into the condenser and producing a potentially explosive mixture.

The present invention provides a simple high efficiency cycle operating at super critical conditions with the working fluid phase change from a liquid to a super critical fluid occurring in both the recuperator and a lower temperature heat source to working fluid heat exchanger, with a higher temperature heat source to working fluid exchanger operating only as a superheater adding temperature to the already super critical working fluid.

SUMMARY OF THE INVENTION

An aspect of the present invention may be an improved recuperated supercritical Rankine cycle, comprising: a working fluid pump with the pump discharge operably connected to a flow splitter with a portion of the working fluid flow from the splitter operably connected to the inlet of the working fluid side of a lower temperature heat source fluid to working fluid heat exchanger (LTHS exchanger) with the inlet of the heat source side of this exchanger operably connected in series with the heat source fluid discharge of a higher temperature heat source fluid to working fluid heat exchanger (HTHS exchanger) and with the heat source fluid discharge of said LTHS exchanger being the final discharge of the heat source fluid from the system, with the inlet of the heat source fluid side of said HTHS exchanger connected to the source of the heat source fluid, and with the working fluid discharge of said LTHS exchanger operably connected to a flow mixer, with the remaining flow from said splitter operably connected to the inlet of the cold side of a high temperature recuperator heat exchanger (HTR exchanger), with the discharge from the cold side of the said HTR exchanger operatively connected to said flow mixer with the discharge of said flow mixer operatively connected to the inlet of the working fluid side of said HTHS exchanger, with the discharge of the working fluid from said HTHS exchanger operatively connected to the inlet of an expander turbine, in which the working fluid is expanded converting energy in the fluid to mechanical power with the exhaust of said turbine expander operatively connected to the inlet of the hot side of said HTR exchanger, with the discharge of the hot side of said HTR exchanger operatively connected to the inlet of a condenser, with the discharge of said condenser operatively connected to the inlet of said working fluid pump.

The preferred operating mode of the cycle when operating with working fluids other than carbon dioxide is for said pump discharge pressure to be high enough that the pressure at the inlet to said expander is above the critical pressure of the working fluid and for the temperature entering said expander turbine be at a temperature above the critical temperature by an amount such that the temperature leaving the expander turbine is hot enough, and the flow entering the HTR exchanger from the flow splitter is low enough that the heat transfer from the hot side working fluid from said expander to the working fluid on the cold side of said HTR exchanger changes the phase of the cold side working fluid from a subcooled liquid state to a supercritical state (both temperature and pressure above the critical values), with the remaining flow from said flow splitter heated in said LTHS exchanger by an exchange of heat from the heat source fluid to the working fluid such that the working fluid entering this exchanger as a subcooled liquid leaves with a change of phase to a supercritical fluid state. The combined stream from said LTHS exchanger and said HTR exchanger enters said HTHS exchanger where, by an exchange of heat from a heat source fluid stream to the combined supercritical working fluid stream, the working combined supercritical working fluid stream is superheated with no phase change and the heat source fluid stream is converted to said lower temperature heat source fluid. The flow split of the working fluid between the HTR exchanger and LTHS exchanger is controlled by a control system to provide optimum cycle performance using known control system art.

An exception to the above mode of operation is when the working fluid used is carbon dioxide. In this instance the working fluid may either be in the supercritical state throughout the cycle, therefore no phase change occurring anywhere in the cycle, or for operations where the lowest temperature and/or pressure in the cycle is less than critical, the phase change to supercritical (with both temperature and pressure being above critical values) may occur in the pump, or in the HTR and LTHS exchangers, or in a lower temperature recuperator heat exchanger (LTR exchanger). For carbon dioxide operation with cycle conditions always above the critical temperature and pressure, the said condenser becomes a working fluid cooler with no condensing taking place. In all operating modes the HTHS exchanger acts as a super heater.

Another aspect of the present invention may be a method of improving the recuperated supercritical Rankine cycle, comprising: pumping a combined subcooled liquid stream to form an above critical pressure fluid stream and transferring said stream to a splitting process; splitting said combined above critical pressure fluid stream into at least a first above critical pressure fluid stream and a second above critical pressure fluid stream; heating said first above critical pressure fluid stream and cooling a partially cooled heat source fluid stream by heat transfer between said first above critical pressure fluid stream and said partially cooled heat source fluid stream to form a first supercritical fluid stream and a further cooled heat source fluid exit stream; heating said second above critical pressure fluid stream and cooling a combined expanded superheated subcritical pressure fluid stream by heat transfer between said second above critical pressure fluid stream and a combined expanded superheated subcritical pressure fluid stream to form a second supercritical fluid stream and a combined reduced temperature superheated subcritical pressure fluid stream; mixing said first supercritical fluid stream and said second supercritical fluid stream to form a combined supercritical fluid stream; heating said combined supercritical fluid stream and cooling a hot heat source fluid stream by heat transfer between said combined supercritical fluid stream and the hot heat source fluid stream to form a combined superheated supercritical fluid stream and said partially cooled heat source stream; expanding said combined superheated supercritical fluid stream to recover energy as mechanical power and form said combined expanded superheated subcritical pressure fluid stream; cooling and condensing said combined reduced temperature superheated subcritical fluid stream and heating a coolant stream by heat transfer between said combined reduced temperature superheated subcritical fluid stream and said coolant stream to form said combined subcooled liquid stream and a heated coolant stream.

An exception to the above mode of operation is when the working fluid used is carbon dioxide. In this instance the working fluid may either be in the supercritical state throughout the cycle, therefore no phase change occurring anywhere in the cycle, or for operations where the lowest temperature and/or pressure in the cycle is less than critical, the change to supercritical (with both temperature and pressure being above critical values) occurs in the pumping process, or in the heating processes of the first and second above critical pressure fluid streams, or in a lower temperature heating process of the first and second above critical pressure fluid streams.

The advantage of this invention, compared to the FIG. 1 cycle when operating in the modes described is much improved efficiency. Compared to many of the other prior art cycles, the proposed cycle, over a wide range of operating conditions has better efficiency with less cycle complexity.

These and various other advantages and features of novelty that characterize the invention are pointed out with particularity in the claims annexed hereto and forming a part hereof. However, for a better understanding of the invention, its advantages and the objects obtained by its use, reference should be made to the drawings and table which forms a further part hereof, and to the accompanying descriptive matter, in which there is illustrated and described, preferred embodiments.

DETAILED DESCRIPTION OF THE PREFERRED EMBODIMENT(S)

For illustrative purposes, the principles of the present disclosure are described by referencing various exemplary embodiments. Although certain embodiments are specifically described herein, one of ordinary skill in the art will readily recognize that the same principles are equally applicable to, and can be employed in other systems and methods.

Before explaining the disclosed embodiments of the present disclosure in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel methods are therefore not limited to the particular arrangement of steps disclosed herein.

It is be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

Figure 1:
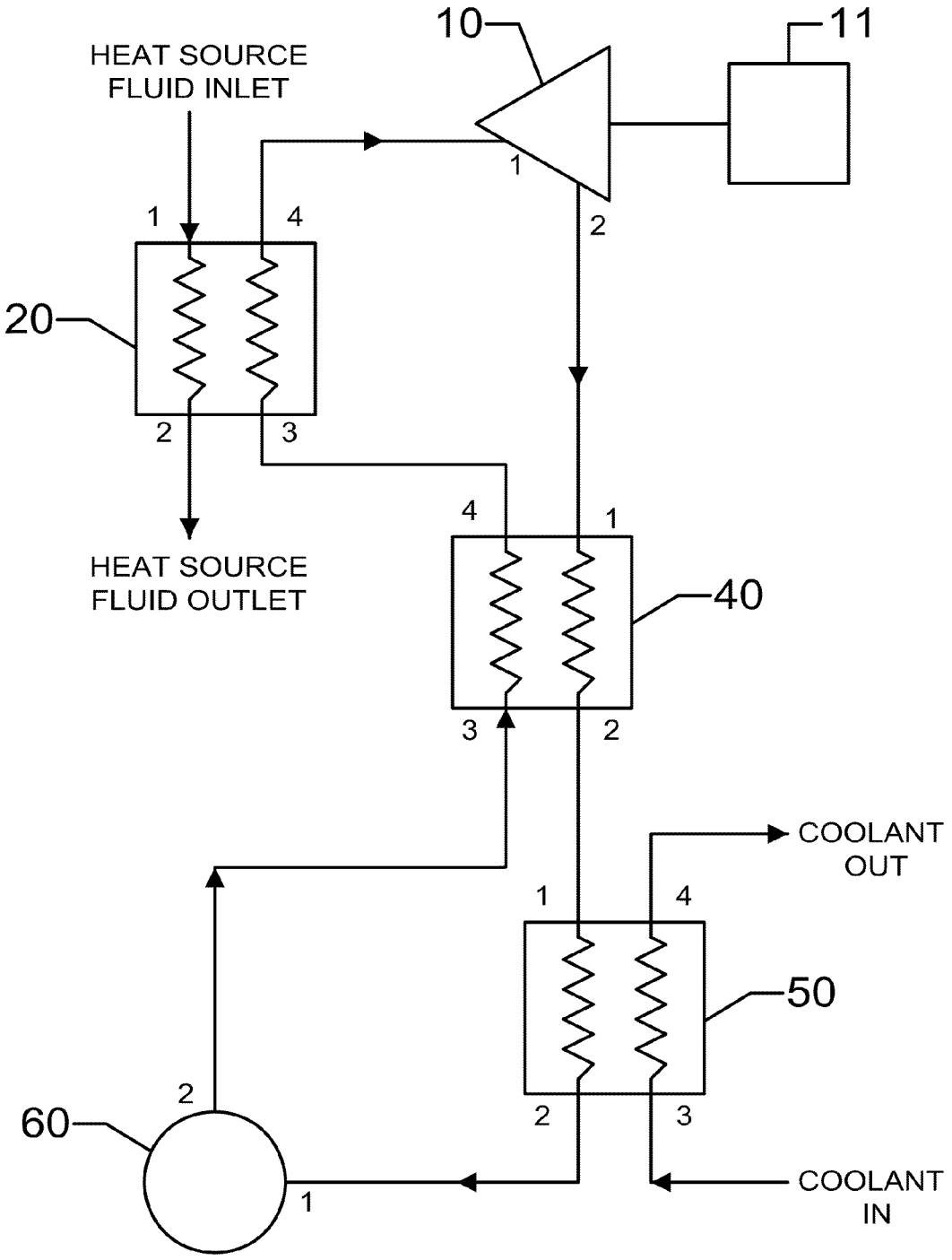
FIG. 1 shows a diagram of a supercritical recuperated Rankine cycle without the improvement of the present invention.

The present invention is directed to an improvement of recuperated supercritical Rankine heat to power thermodynamic cycles. The invention may be applied to the simple Rankine cycle as shown in FIG. 1. FIG. 1 includes a single heat source heat exchanger 20 a single recuperator 40, a single expansion turbine 10, driven machine 11 a single condenser 50, and a single pump 60.

Alternatively, the present invention may be applied to more complex cycles with one or more heat source exchangers, recuperator heat exchangers expansion turbines and condensers, including cycles in which one or more of the recuperators is fed on the hot side by another recuperator.

The present invention may also be applied to certain closed loop Brayton cycles, particularly those using carbon dioxide as a working fluid.

The present invention may be incorporated into a heat recovery power cycle as it is being designed and built, or may be added to an existing cycle as a retrofit.

Figure 2:
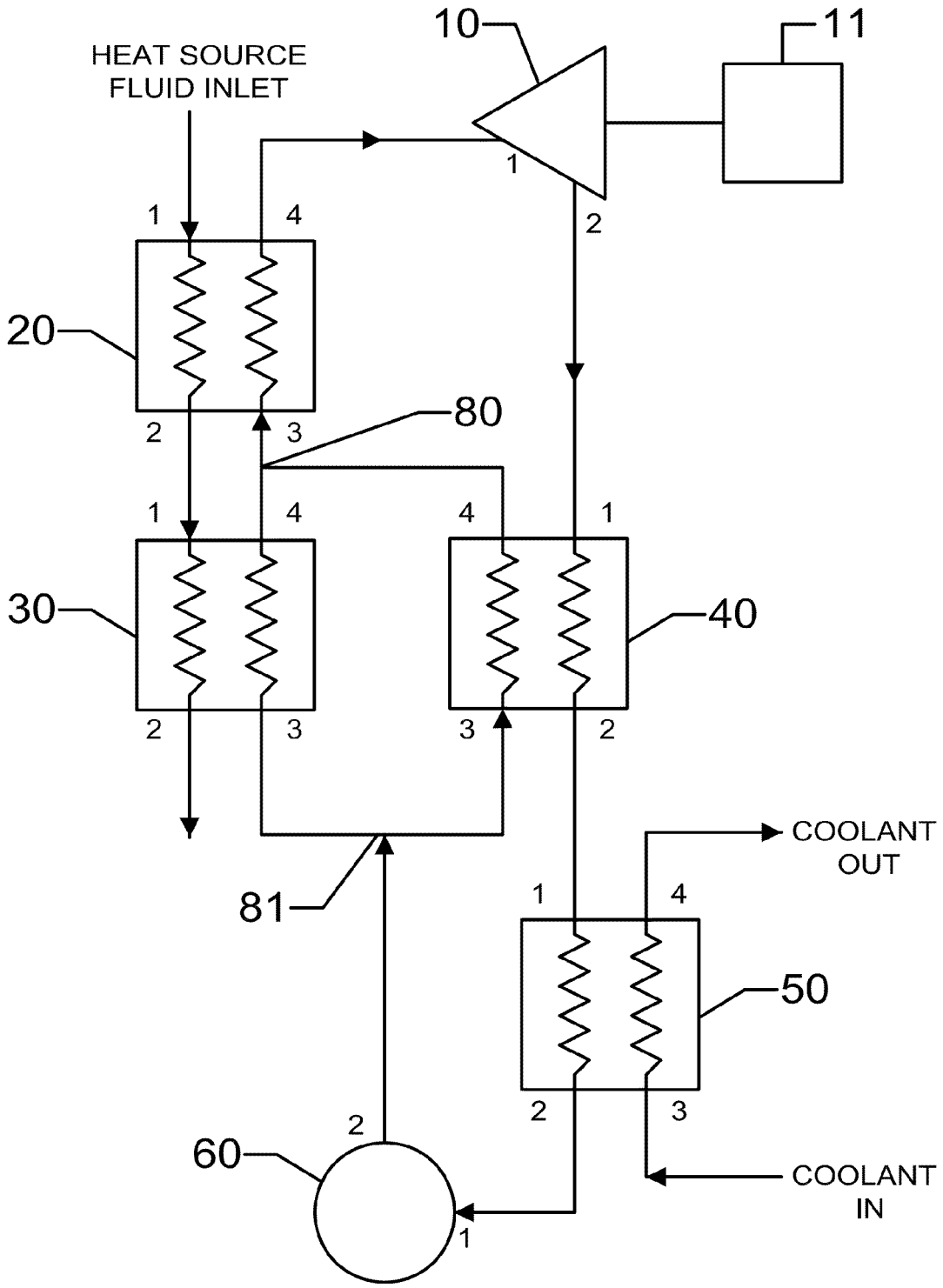
FIG. 2 shows a diagram of the present supercritical recuperated Rankine cycle invention in a first embodiment.

In a first embodiment of the invention an additional heat exchanger 30 (which may be a lower temperature heat source fluid to working fluid (LTHS) heat exchanger) is added to the supercritical recuperated Rankine cycle, such as that shown in FIG. 1, to form the supercritical recuperated Rankine cycle. The low temperature heat source fluid to working fluid (LTHS) heat exchanger 30 in FIG. 2, is an added heat exchanger that is connected in series with the outlet 2 of the heat source fluid side of the high temperature heat source fluid to working fluid (HTHS) exchanger 20, which is a higher temperature heat source fluid to working fluid heat exchanger. The heat source fluid for HTHS exchanger 20 can be any source of heat fluid such as waste heat exhaust fluid of an engine gas turbine, fuel cell, or waste heat from an industrial process or any heat source of sufficient temperature.

The working fluid side of the LTHS exchanger 30 is connected in parallel with the cold working fluid side of recuperator heat exchanger 40, which is referred to herein as the high temperature recuperator heat exchanger 40 (HTR exchanger 40). The above critical pressure liquid working fluid stream from the discharge 2 of pump 60 is split in a flow splitter 81 between the inlet 3 of the HTR exchanger 40 and the inlet 3 of the LTHS exchanger 30. The split above critical pressure liquid working fluid streams, after absorbing heat from the heat source fluid stream in LTHS exchanger 30 and from the combined subcritical pressure superheated working fluid stream. from expander 10 in HTR exchanger 40 and changing phase in these exchangers to form supercritical fluid streams then exit the cold sides of the HTR exchanger 40 at outlet 4 and the LTHS exchanger 30 at outlet 4 and mixed in a flow mixer 80 to form a combined supercritical working fluid stream prior to entering the HTHS exchanger 20 at inlet 3. HTHS exchanger 20 superheats the combined supercritical working fluid to a higher temperature, to form a combined superheated supercritical working fluid stream directed to the inlet 1 of expander turbine 10 wherein said combined superheated supercritical working fluid stream is expanded to a lower pressure thereby converting energy in the working fluid to mechanical power, and reducing the working fluid temperature and pressure to form said combined subcritical pressure superheated working fluid stream.

After exiting the expander turbine 10 at outlet 2 the combined subcritical pressure superheated working fluid stream, is directed to the hot side inlet 1 of HTR exchanger 40 where it is cooled as it exchanges heat with the portion of said above critical pressure liquid working fluid stream entering the cold side of HTR exchanger 40. The cooled combined working fluid stream, which remains a superheated vapor, is then directed to the inlet 1 of condenser heat exchanger 50 where the working fluid is cooled and condensed to the liquid state by exchanging heat with the condenser coolant, this combined liquid working fluid stream then flows to inlet 1 of the pump 60. The condenser 50 can cool and condense the working fluid using any source of cooling medium such as a source of cooling water or cooling air or a cool process stream that would benefit from absorbing the condenser heat.

Figure 3:
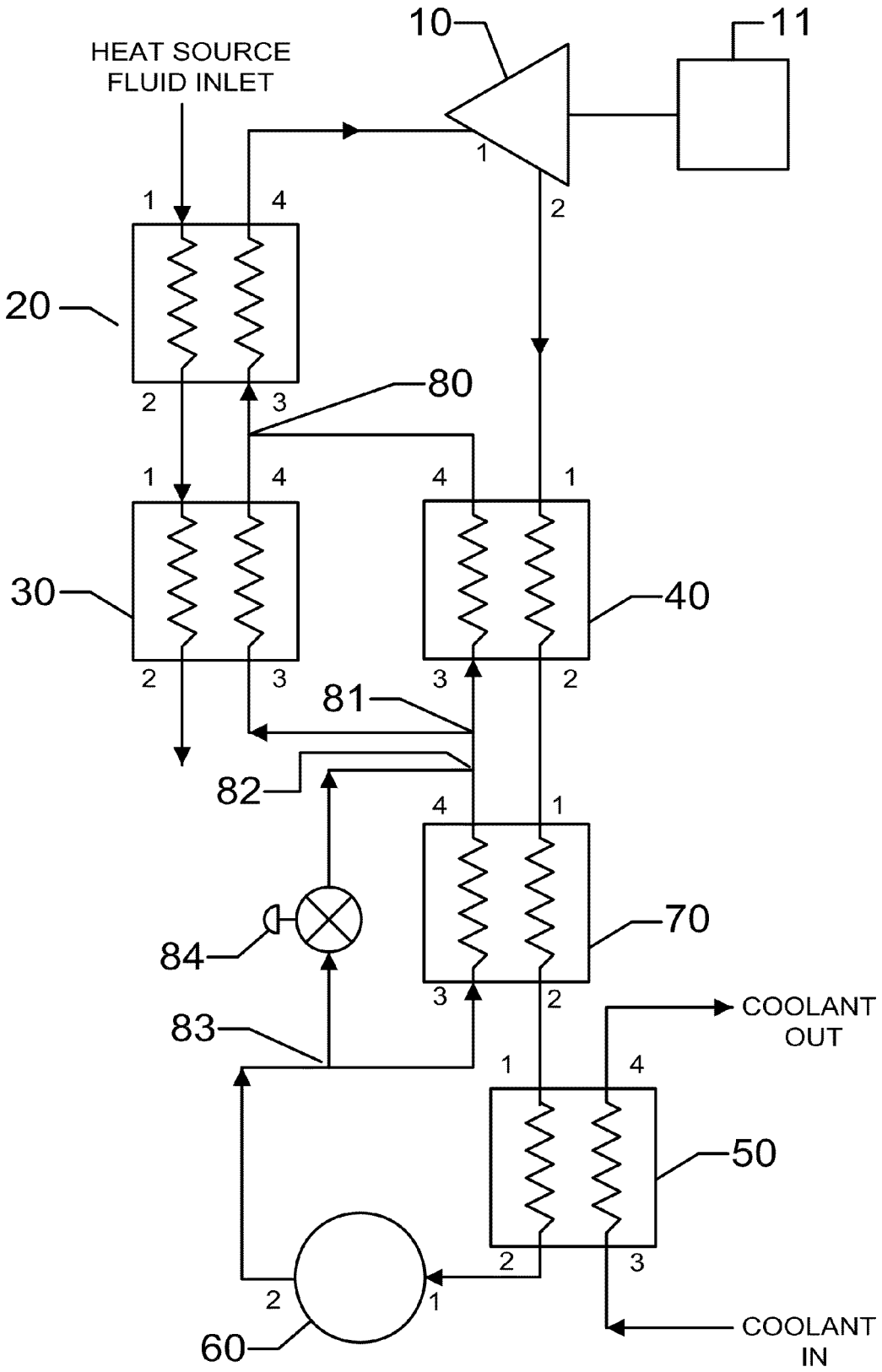
FIG. 3 shows a diagram of the present super critical recuperated Rankine cycle invention in a second embodiment.

In a second embodiment of the invention an additional recuperator heat exchanger 70, a flow divider 83, a temperature controlled bypass valve 84 and a flow mixer 82 are added to the cycle shown in FIG. 2 to form the cycle shown in FIG. 3. This additional recuperator heat exchanger 70 is hereinafter referred to as the lower temperature recuperator heat exchanger (LTR exchanger 70).

As can be seen in FIG. 3, the LTR exchanger 70 high temperature side inlet 1 and low temperature side outlet 4 are operatively connected respectively to the high temperature side outlet 2 of HTR exchanger 40 and an inlet to flow splitter 81, the high temperature outlet 2 and low temperature inlet 3 are operatively connected respectively to the inlet 1 of condenser 50 and an outlet of splitter 83.

The purpose of the LTR exchanger 70 with the temperature controlled bypass is to provide a small rise in temperature of the working fluid stream entering LTHS exchanger 30, for applications in which the heat source fluid is a gaseous fluid containing both water vapor and acid forming compounds such as carbon dioxide or hydrogen sulfide as is often found in engine or gas turbine exhaust or other gaseous waste heat streams, such that the working fluid temperature entering the LTHS heat exchanger 30 at inlet 3 is above the partial pressure saturation temperature of the water vapor in the gaseous heat source fluid stream, thus preventing water condensation on the heat exchanger surfaces of LTHS heat exchanger 30 and the forming of acidic compounds. Temperature controlled bypass valve 84 allows the bypassing of a portion of the cold working fluid around the LTR exchanger 70 to control the mixed temperature of the bypassed stream plus the unbypassed stream exiting mixer 81 and directed to LTHS exchanger 30 and HTR exchanger 40. In most operating modes the increased temperature of the working fluid streams entering LTHS exchanger 30 and HTR exchanger 40 has a negative impact on the cycle performance therefore the temperature rise of the mixed stream exiting flow mixer 82 should be maintained (by controlling the flow through bypass valve 84) to the minimum required to prevent condensation on the LTHS exchanger 30 heat transfer surfaces.

Figure 4:
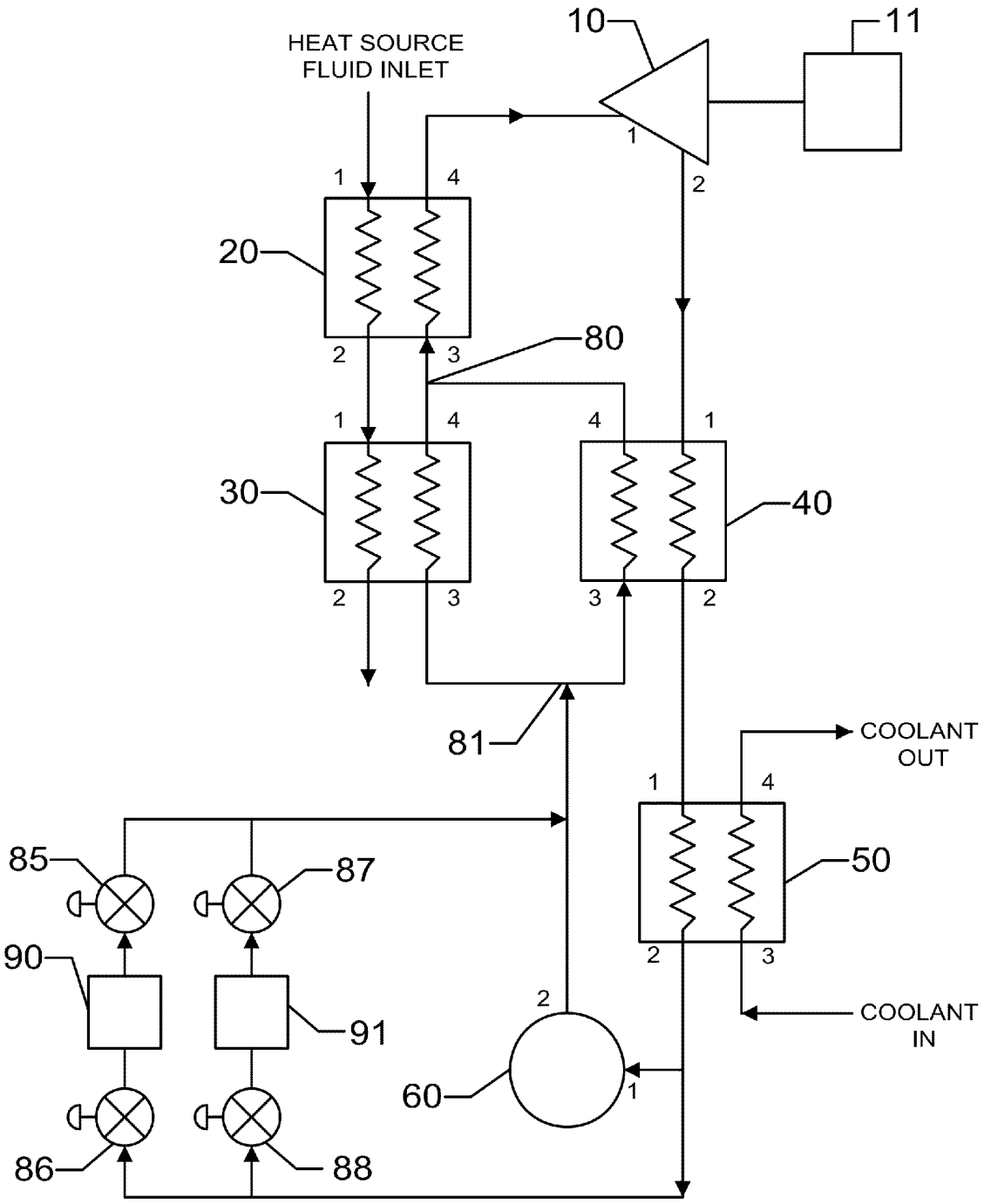
FIG. 4 shows a diagram of the present supercritical recuperated Rankine cycle invention in a third embodiment for operation with $CO_2$ as the working fluid in the Brayton or Rankine (condensing or non-condensing) modes.

In a third embodiment of the invention, the cycle shown in FIG. 2 is modified to the cycle shown in FIG. 4. The purpose of the modifications is to accommodate carbon dioxide as the cycle working fluid, for operation in a non-condensing Brayton type operating mode, by providing a means to control the system pressures when in the non-condensing mode. A multiplicity of volume pressure vessels shown as 90, 91, in FIG. 4 are included in the cycle, the number and size determined by the range of operating conditions (coolant and heat source temperature ranges) that the cycle is to be designed to operate under, each vessel operatively connected through control valves 85, 86, 87, and 88 to piping header systems, with one header system operatively connected to the discharge side of pump 60 and the other header system operatively connected to the suction side of the pump 60. By proper actuation of the pressure vessel control valves, including timing, the active volume of the system and the ratio of the active volumes between the high and low pressure sides of the cycle can be adjusted as well as the active working fluid mass in the system. The ability to change the ratio of volumes between the high and low pressure sides and the system active working fluid mass, in conjunction with provisions to adjust the head of the pump 60 (by speed control or other known means of controlling the head), and the pressure drop across the expander turbine 10 allows for the control of the pressure on the high and low pressure sides of the system when operating in the non-condensing mode. For operation with carbon dioxide as the working fluid there is no change of phase of the carbon dioxide working fluid in the cycle when the lowest cycle pressure and temperature are both above critical values. When operating with carbon dioxide as the working fluid with the highest cycle pressure above critical but the lowest temperature or pressure under the critical values, a change of phase from liquid to supercritical with both the temperature and the pressure above critical values may occur either in the pump 60 or the LTHS heat exchanger 30 and the HTR exchanger 40 or the LTR exchanger 70. The HTHS heat exchanger 20 operates as a supercritical super heater increasing the temperature of the supercritical carbon dioxide entering the exchanger.

Figure 5:
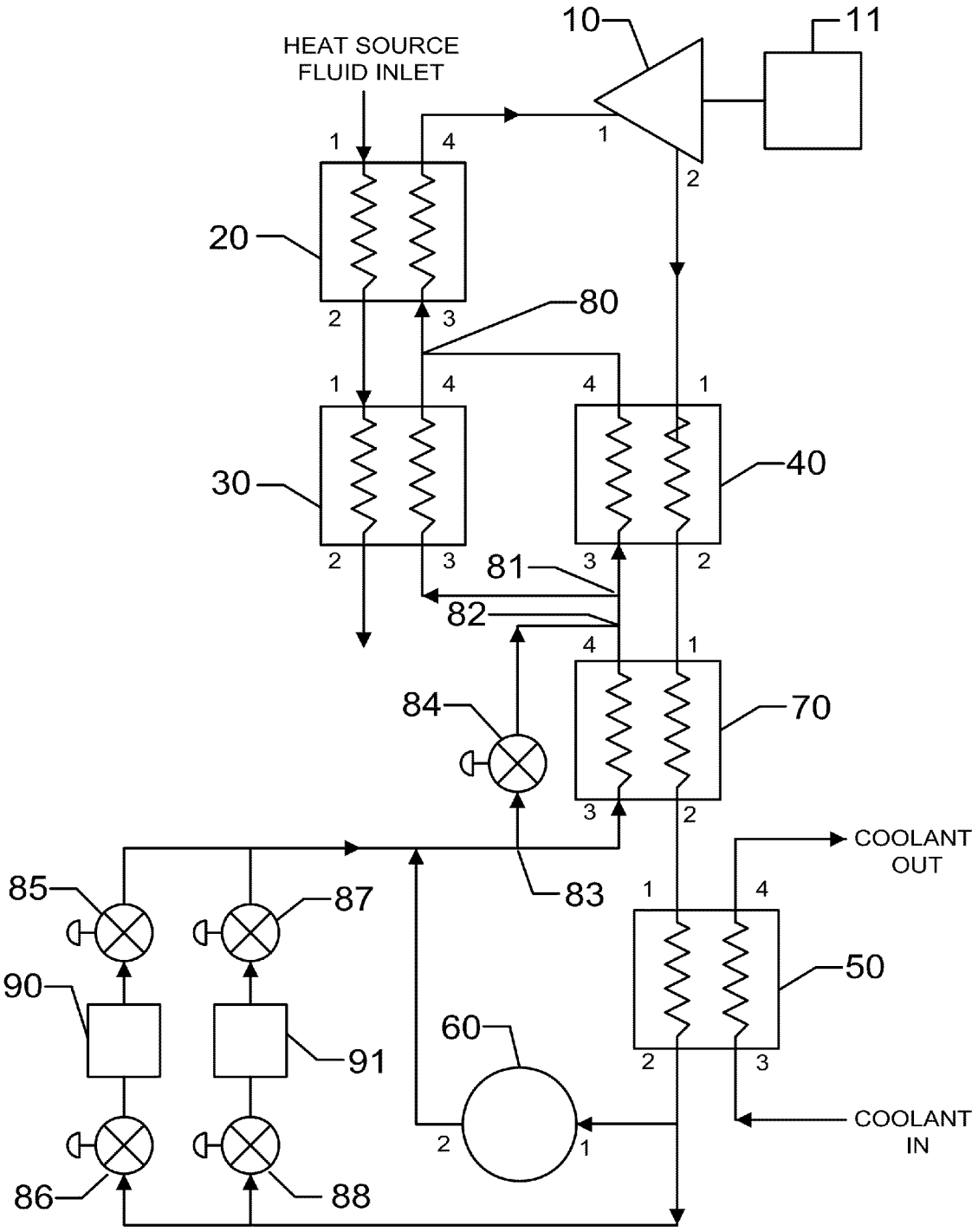
FIG. 5 shows a diagram of the present supercritical recuperated Rankine cycle invention in a fourth embodiment for operation with $CO_2$ as the working fluid in the Brayton or Rankine (condensing or non-condensing) modes.

In a fourth embodiment of the invention shown in FIG. 5, the LTR exchanger 70 and bypass system shown in FIG. 3 and described in the second embodiment description, is added to the third embodiment shown in FIG. 4. The purpose for adding this LTR exchanger 70 is the same as described for the invention shown in second embodiment discussed above. The phase change of the carbon dioxide working fluid to the supercritical condition may occur in this exchanger.

All embodiments of the cycle are not limited to heat being supplied only by the heat source fluid entering at the inlet of the HTHS heat exchanger 20, but heat may be added at any point in the cycle where adding heat would be beneficial, such as adding heat to the heat source stream between the HTHS heat exchanger 20 and the LTHS exchangers 30.

The expander turbine 10 for any of the embodiments can be any type of mechanical device that expands a gas and converts heat and pressure energy in the gas to mechanical power, such, as for example, a bladed turbine, a radial inflow expander, a piston expansion engine, or a screw or lobe type expander. The expansion can take place in a single expander turbine 10 or two or more expander turbines in series, or series parallel, making up a single expansion process, as required to best fit the expansion duty to available equipment. The power output from the turbine expander 10 is used to drive driven machine 11. Driven machine 11 may be a generator, or a pump, or a compressor or any other power requiring equipment.

Splitting the working fluid between the LTHS exchanger 30 and the HTR exchanger 40 provides for a higher working fluid exit temperature from the recuperator, a significant increase in the total heat recovered in the HTHS exchanger 20 and the LTHS exchanger 30 compared to the amount of heat recovered in the FIG. 1 cycle HTHS exchanger 20, and an increase in the working fluid mass flowing through the system and thus an increase in the net power of the cycle.

The invention is not limited to specific working fluids except by the need to match the thermodynamic properties of the fluid to the thermodynamic cycle requirements of phase change, as mentioned above. For example, for embodiments 1 and 2, propane is a fluid that easily meets the thermodynamic phase change needs. Propane has a relatively high critical pressure and low critical temperature (compared for instance to refrigerant R245fa) and has a relatively high thermal stability limit. R245fa, for example, is an unacceptable fluid for this cycle due to the combination of low thermal stability temperature, high critical pressure and low critical temperature. The invention is not limited to a single component working fluid.

A control system (not shown in the figures) with valves, controllers, orifices, instrumentation, sensors, etc., as known to one of ordinary skill in the art is used to control the mass flow and pressure of the working fluid and the flow split of the working fluid between HTR exchanger 40 and LTHS heat exchanger 30 to optimize the cycle power output within constraints such as minimum allowable final exhaust temperature of the heat source fluid exiting from the LTHS exchanger 30.

It should be recognized that the figures presented are meant only to represent the inventive thermodynamic cycle. It should be understood that in the final working system, there will be relief and control valves, orifices, fluid accumulators, fluid reservoirs, pump drivers, turbine expander driven machines, instrumentation, controls and other known art devices used to implement the thermodynamic cycle.

Tables 1 and 2 show the thermodynamic conditions of the working fluid and heat source fluid at various points in the FIG. 1, and FIG. 2 cycles and the required pump power and the expander output power when using propane as the working fluid and gas turbine exhaust as the heat source fluid, using the same set of operating parameters of heat source fluid temperature and flow and working fluid temperature entering the pump for each cycle. Tables 3 and 4 is a similar comparison of the FIG. 1 cycle to the FIG. 4 cycle at a different set of operating conditions and using carbon dioxide as the working fluid. As can be seen in the Table 1 and Table 2 and Table 3 and Table 4 examples, the improvement in net power (the expander power less the pump power) of the current invention versus the FIG. 1 cycle is 37% and 30% respectively. The efficiency improvement is dependent on the operating conditions and selected working fluid.

TABLE 1

| Without Improvement (FIG. 1 System data) | | | | | | | | | | | | | |
|---|---|---|---|---|---|---|---|---|---|---|---|---|---|
| Device Number and Point in Cycle per FIGS. 1 and 2 | 60-1 | 60-2 | 30-4 | 40-4 | 20-3 | 20-4 | 20-1 | 20-2 | 30-2 | 40-1 | 40-2 | 10 | 60 |
| Flow lb/s | 47.1 | 47.1 | N/A | 47.1 | 47.1 | 47.1 | 100 | 100 | N/A | 47.1 | 47.1 | | |
| Temperature ° F. | 88 | 98 | N/A | 271.9 | 271.9 | 545 | 700 | 316.9 | N/A | 424.6 | 126 | | |
| Pressure psia | 161 | 970 | N/A | 960 | 960 | 950 | 14.8 | 14.7 | N/A | 164.5 | 162 | | |
| Enthalpy BTU/LB | 121.2 | 127.8 | N/A | 289.3 | 289.3 | 498.3 | 329.6 | 231.1 | N/A | 441 | 279.4 | | |
| Shaft Power KW | | | | | | | | | | | | 2851 | 326 |

TABLE 2

| With Improvement (FIG. 2 System data) | | | | | | | | | | | | | |
|---|---|---|---|---|---|---|---|---|---|---|---|---|---|
| Device Number and Point in Cycle per FIGS. 1 and 2 | 60-1 | 60-2 | 30-4 | 40-4 | 20-3 | 20-4 | 20-1 | 20-2 | 30-2 | 40-1 | 40-2 | 10 | 60 |
| Flow lb/s | 69 | 69 | 27 | 42 | 69 | 69 | 100 | 100 | 100 | 69 | 69 | | |
| Temperature ° F. | 88 | 98 | 340.3 | 340.4 | 340.4 | 505.2 | 700 | 385.4 | 143.1 | 383.2 | 126 | | |
| Pressure psia | 161 | 970 | 960 | 960 | 960 | 950 | 14.9 | 14.8 | 14.7 | 164.6 | 162 | | |
| Enthalpy BTU/LB | 121.2 | 127.8 | 352.3 | 352.4 | 352.3 | 470.1 | 329.6 | 248.4 | 187.8 | 416.1 | 279.5 | | |
| Shaft Power KW | | | | | | | | | | | | 3928 | 476 |

TABLE 3

| Without Improvement (FIG. 1 System data) | | | | | | | | | | | | | |
|---|---|---|---|---|---|---|---|---|---|---|---|---|---|
| Device Number and Point in Cycle per FIGS. 1 and 2 | 60-1 | 60-2 | 30-4 | 40-4 | 20-3 | 20-4 | 20-1 | 20-2 | 30-2 | 40-1 | 40-2 | 10 | 60 |
| Flow lb/s | 146.8 | 146.8 | N/A | 146.8 | 146.8 | 146.8 | 100 | 100 | N/A | 100 | 100 | | |
| Temperature ° F. | 98 | 162.1 | N/A | 397.6 | 397.6 | 725 | 1000 | 442.6 | N/A | 560.3 | 190.1 | | |
| Pressure psia | 1255 | 3200 | N/A | 3185 | 3185 | 3170 | 14.8 | 14.7 | N/A | 1270 | 1265 | | |
| Enthalpy BTU/LB | 137.71 | 150.1 | N/A | 256.3 | 256.3 | 356.7 | 410.3 | 262.9 | N/A | 319.7 | 213.5 | | |
| Shaft Power KW | | | | | | | | | | | | 5728 | 1918 |

TABLE 4

| With Improvement (FIG. 4 System data): | | | | | | | | | | | | | |
|---|---|---|---|---|---|---|---|---|---|---|---|---|---|
| Device Number and Point in Cycle per FIGS. 1 and 2 | 60-1 | 60-2 | 30-4 | 40-4 | 20-3 | 20-4 | 20-1 | 20-2 | 30-2 | 40-1 | 40-2 | 10 | 60 |
| Flow lb/s | 213.8 | 213.8 | 58.07 | 155.7 | 213.8 | 213.8 | 100 | 100 | 100 | 213.8 | 213.8 | | |
| Temperature ° F. | 98 | 155.7 | 442.9 | 443.1 | 443.0 | 650.7 | 1000 | 488.0 | 200.8 | 493.8 | 183.8 | | |
| Pressure psia | 1280 | 3200 | 3185 | 3185 | 3185 | 3170 | 14.9 | 14.8 | 14.7 | 1295.0 | 1290 | | |
| Enthalpy BTU/LB | 135.1 | 146.5 | 271.2 | 271.2 | 271.2 | 334.7 | 410.3 | 274.5 | 202.1 | 301.4 | 210.5 | | |
| Shaft Power KW | | | | | | | | | | | | 7520 | 2561 |

It is to be understood, however, that even though numerous characteristics and advantages of the present invention have been set forth in the foregoing description, together with details of the method, composition and function of the invention, the disclosure is illustrative only, and changes may be made in detail, within the principles of the invention to the full extent indicated by the broad general meaning of the terms in which the appended claims are expressed.

Although the invention has been described using relative terms such as "down," "out," "top," "lower", "higher" "bottom," "over," "above," "under" and the like in the description and in the claims, such terms are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Unless stated otherwise, terms such as "first" and "second" are used to arbitrarily distinguish between the elements such terms describe. Thus, these terms are not necessarily intended to indicate temporal or other prioritization of such elements. Further, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

It is to be understood, however, that even though numerous characteristics and advantages of the present invention have been set forth in the foregoing description, together with details of the method, composition and function of the invention, the disclosure is illustrative only, and changes may be made in detail, within the principles of the invention to the full extent indicated by the broad general meaning of the terms in which the appended claims are expressed.

Other embodiments of the present disclosure will be apparent to those skilled in the art from consideration of the specification and practice of the embodiments disclosed herein. It is intended that the specification and examples be considered as exemplary only, with a true scope of the disclosure being indicated by the following claims.

All documents mentioned herein are hereby incorporated by reference in their entirety or alternatively to provide the disclosure for which they were specifically relied upon.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The applicant(s) do not intend to dedicate any disclosed embodiments to the public, and to the extent any disclosed modifications or alterations may not literally fall within the scope of the claims, they are considered to be part hereof under the doctrine of equivalents.

What is claimed is:

1. A thermodynamic system comprising:

a pump having a low-pressure input port connected to a high-pressure output port;

a first flow divider having an input port connected to first and second output ports, wherein (i) the input port of the first flow divider is connected to the high-pressure output port of the pump and (ii) the first flow divider divides a working fluid stream received at the input port of the first flow divider into working fluid streams at the first and second output ports of the first flow divider;

a first recuperator having (i) a first port connected to a second port and (ii) a third port connected to a fourth port, wherein the third port of the second recuperator is connected to the first output port of the first flow divider;

a bypass valve having an input port connected to an output port, wherein the input port of the bypass valve is connected to the second output port of the first flow divider; and a first flow mixer having first and second input ports connected to an output port, wherein (i) the first input port of the first flow mixer is connected to the fourth port of the first recuperator, (ii) the second input port of the first flow mixer is connected to the output port of the bypass valve, and (iii) the first flow mixer combines working fluid streams received at the first and second input ports of the first flow mixer into a working fluid stream at the output port of the first flow mixer;

a second flow divider having an input port connected to first and second output ports, wherein (i) the input port of the second flow divider is connected to the output port of the first flow mixer and (ii) the second flow divider divides a working fluid stream received at the input port of the second flow divider into working fluid streams at the first and second output ports of the second flow divider;

a first heat exchanger having (i) a first port connected to a second port and (ii) a third port connected to a fourth port, wherein the third port of the first heat exchanger is connected to the first output port of the second flow divider;

a second recuperator having (i) a first port connected to a second port and (ii) a third port connected to a fourth port, wherein:

the third port of the second recuperator is connected to the second output port of the second flow divider; and the second port of the second recuperator is connected to the first port of the first recuperator;

a second flow mixer having first and second input ports connected to an output port, wherein (i) the first input port of the second flow mixer is connected to the fourth port of the first heat exchanger, (ii) the second input port of the second flow mixer is connected to the fourth port of the second recuperator, and (iii) the second flow mixer combines working fluid streams received at the first and second input ports of the second flow mixer into a working fluid stream at the output port of the second flow mixer;

a second heat exchanger having (i) a first port connected to a second port and (ii) a third port connected to a fourth port, wherein:

the third port of the second heat exchanger is connected to the output port of the second flow mixer; and the second port of the second heat exchanger is connected to the first port of the first heat exchanger;

an expansion device that converts fluid energy into mechanical energy, the expansion device having a high-pressure input port connected to a low-pressure output port, wherein:

the high-pressure input port of the expansion device is connected to the fourth port of the second heat exchanger; and the low-pressure output port of the expansion device is connected to the first port of the second recuperator;

a condenser/cooler having (i) a first port connected to a second port and (ii) a third port connected to a fourth port, wherein (a) the first port of the condenser/cooler is connected to the second port of the first recuperator and (b) the second port of the condenser/cooler is connected to the low-pressure input port of the pump, wherein:

within the first heat exchanger, heat flows from a heat-source fluid stream received at the first port of the first heat exchanger to the working fluid stream received at the third port of the first heat exchanger;

within the second heat exchanger, heat flows from a heat-source fluid stream received at the first port of the second heat exchanger to the working fluid stream received at the third port of the second heat exchanger;

within the first recuperator, heat flows from a working fluid stream received at the first port of the first recuperator to a working fluid stream received at the third port of the first recuperator;

within the second recuperator, heat flows from a working fluid stream received at the first port of the second recuperator to a working fluid stream received at the third port of the second recuperator;

within the condenser/cooler, heat flows from a working fluid stream received at the first port of the condenser/cooler to a cooling fluid stream received at the third port of the condenser/cooler; and within the thermodynamic system, the working fluid streams from the high-pressure output port of the pump to the high-pressure input port of the expansion device are all above the critical pressure of the working fluid.

2. The thermodynamic system of claim 1, wherein the working fluid streams from the low-pressure output port of the expansion device to the low-pressure input port of the pump are all below the critical pressure of the working fluid.

3. The thermodynamic system of claim 1, wherein the working fluid streams from the low-pressure output port of the expansion device to the low-pressure input port of the pump are all above the critical pressure of the working fluid.

4. The thermodynamic system of claim 2, wherein:

the working fluid stream received at the third port of the second heat exchanger is supercritical with both the temperature and pressure above the critical values of the working fluid; and the working fluid stream output from the fourth port of the second heat exchanger is supercritical with a temperature greater than the temperature of the working fluid stream received at the third port.

5. The thermodynamic system of claim 3, wherein:

the working fluid stream received at the third port of the second heat exchanger is supercritical with both the temperature and pressure above the critical values of the working fluid; and the working fluid stream output from the fourth port of the second heat exchanger is supercritical with a temperature greater than the temperature of the working fluid stream received at the third port.

6. A method for implementing a thermodynamic cycle using a thermodynamic system, the thermodynamic system comprising:

a pump having a low-pressure input port connected to a high-pressure output port;

a first flow divider having an input port connected to first and second output ports, wherein the input port of the first flow divider is connected to the high-pressure output port of the pump;

a first heat exchanger having (i) a first port connected to a second port and (ii) a third port connected to a fourth port, wherein the third port of the first heat exchanger is connected to the first output port of the first flow divider;

a first recuperator having (i) a first port connected to a second port and (ii) a third port connected to a fourth port, wherein the third port of the first recuperator is connected to the second output port of the first flow divider;

a first flow mixer having first and second input ports connected to an output port, wherein (i) the first input port of the first flow mixer is connected to the fourth port of the first heat exchanger and (ii) the second input port of the first flow mixer is connected to the fourth port of the first recuperator;

a second heat exchanger having (i) a first port connected to a second port and (ii) a third port connected to a fourth port, wherein the third port of the second heat exchanger is connected to the output port of the first flow mixer;

an expansion device that converts fluid energy into mechanical energy, the expansion device having a high-pressure input port connected to a low-pressure output port, wherein:

the high-pressure input port of the expansion device is connected to the fourth port of the second heat exchanger; and the low-pressure output port of the expansion device is connected to the first port of the first recuperator; and a condenser/cooler having (i) a first port connected to a second port and (ii) a third port connected to a fourth port, wherein (a) the first port of the condenser/cooler is connected to the second port of the first recuperator and (b) the second port of the condenser/cooler is connected to the low-pressure input port of the pump, wherein:

the second port of the second heat exchanger is connected to the first port of the first heat exchanger; and the working fluid streams from the high-pressure output port of the pump to the high-pressure input port of the expansion device are all above the critical pressure of the working fluid, the method for implementing the thermodynamic cycle comprising:

(a) using the pump to increase pressure of the working fluid stream received at the low-pressure input port of the pump into the working fluid stream above the critical pressure at the high-pressure output port of the pump;

(b) using the first flow divider to divide the working fluid stream above the critical pressure received at the input port of the first flow divider into the working fluid streams above the critical pressure at the first and second output ports of the first flow divider;

(c) using the first heat exchanger to transfer heat from a heat-source fluid stream received at the first port of the first heat exchanger to the working fluid stream above the critical pressure received at the third port of the first heat exchanger;

(d) using the first recuperator to transfer heat from the working fluid stream received at the first port of the first recuperator to the working fluid stream above the critical pressure received at the third port of the first recuperator;

(e) using the first flow mixer to combine the working fluid streams above the critical pressure received at the first and second input ports of the first flow mixer into the working fluid stream above the critical pressure at the output port of the first flow mixer;

(f) using the second heat exchanger to transfer heat from a heat-source fluid stream received at the first port of the second heat exchanger to the working fluid stream above the critical pressure received at the third port of the second heat exchanger;

(g) using the expansion device to expand the working fluid stream above the critical pressure received at the high-pressure input port of the expansion device into the working fluid stream at the low-pressure output port of the expansion device; and (h) using the condenser/cooler to transfer heat from the working fluid stream received at the first port of the condenser/cooler to a cooling fluid stream received at the third port of the condenser/cooler, and the method for implementing the thermodynamic cycle is configured to:

convert the working fluid stream from a liquid state into a supercritical fluid state between (i) the input port of the pump and (ii) the third port of the second heat exchanger.

7. The method of claim 6, wherein the working fluid streams from the low-pressure output port of the expansion device to the low-pressure input port of the pump are all below the critical pressure.

8. The method of claim 6, wherein:

the working fluid stream is received at the third port of the first heat exchanger in the liquid state and converted within the first heat exchanger into the working fluid stream output at the fourth port of the first heat exchanger in the supercritical fluid state; and the working fluid stream is received at the third port of the first recuperator in liquid state and converted within the first recuperator into the working fluid stream output at the fourth port of the first recuperator in the supercritical fluid state.

9. The method of claim 6, wherein the working fluid streams from the low-pressure output port of the expansion device to the low-pressure input port of the pump are all above the critical pressure.

10. The method of claim 6, wherein the working fluid is a single-component working fluid.

11. The method of claim 6, wherein the working fluid is a multi-component working fluid.

12. The method of claim 6, wherein:

the thermodynamic system further comprises:

a second flow divider having an input port connected to first and second output ports, wherein the input port of the second flow divider is connected to the high-pressure output port of the pump;

a second recuperator having (i) a first port connected to a second port and (ii) a third port connected to a fourth port, wherein:

the first port of the second recuperator is connected to the second port of the first recuperator;

the second port of the second recuperator is connected to the first port of the condenser/cooler; and the third port of the second recuperator is connected to the first output port of the second flow divider;

a bypass valve having an input port connected to an output port, wherein the input port of the bypass valve is connected to the second output port of the second flow divider; and a second flow mixer having first and second input ports connected to an output port, wherein (i) the first input port of the second flow mixer is connected to the fourth port of the second recuperator, (ii) the second input port of the second flow mixer is connected to the output port of the bypass valve, and (iii) the output port of the second flow mixer is connected to the input port of the first flow divider; and the method further comprises:

(i) using the second flow divider to divide the working fluid stream above the critical pressure received at the input port of the second flow divider into the working fluid streams above the critical pressure at the first and second output ports of the second flow divider;

(j) using the second recuperator to transfer heat from the working fluid stream received at the first port of the second recuperator to the working fluid stream above the critical pressure received at the third port of the second recuperator;

(k) using the bypass valve to regulate the amount of working fluid stream passing from the input port of the bypass valve to the output port of the bypass valve; and (l) using the second flow mixer to combine the working fluid streams above the critical pressure received at the first and second input ports of the second flow mixer into the working fluid stream above the critical pressure at the output port of the second flow mixer.

* * * * *